US007910519B2

(12) United States Patent
Majumdar et al.

(10) Patent No.: US 7,910,519 B2
(45) Date of Patent: Mar. 22, 2011

(54) AQUEOUS SUBBING FOR EXTRUDED THERMAL DYE RECEIVER

(75) Inventors: Debasis Majumdar, Rochester, NY (US); Narasimharao Dontula, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 948 days.

(21) Appl. No.: 11/681,802

(22) Filed: Mar. 5, 2007

(65) Prior Publication Data

US 2008/0220190 A1 Sep. 11, 2008

(51) Int. Cl.
*B41M 5/035* (2006.01)
*B41M 5/50* (2006.01)

(52) U.S. Cl. ..... 503/227; 427/152

(58) Field of Classification Search ..... None
See application file for complete search history.

(56) References Cited

U.S. PATENT DOCUMENTS

| | | | |
|---|---|---|---|
| 4,695,286 | A | 9/1987 | Vanier et al. |
| 4,748,150 | A | 5/1988 | Vanier et al. |
| 4,774,224 | A | 9/1988 | Campbell |
| 4,814,321 | A | 3/1989 | Campbell |
| 4,897,377 | A | 1/1990 | Marbrow |
| 4,908,345 | A | 3/1990 | Egashira et al. |
| 4,927,803 | A | 5/1990 | Bailey et al. |
| 4,965,238 | A | 10/1990 | Henzel |
| 4,965,239 | A | 10/1990 | Henzel |
| 5,112,799 | A | 5/1992 | Egashira et al. |
| 5,302,574 | A | 4/1994 | Lawrence et al. |
| 5,368,995 | A | 11/1994 | Christian et al. |
| 5,384,304 | A | 1/1995 | Kung et al. |
| 5,387,571 | A | 2/1995 | Daly |
| 5,411,931 | A | 5/1995 | Kung |
| 5,646,090 | A | 7/1997 | Tamura et al. |
| 5,718,995 | A | 2/1998 | Eichorst et al. |
| 5,719,016 | A | 2/1998 | Christian et al. |
| 5,858,916 | A | 1/1999 | Kung et al. |
| 6,096,685 | A | 8/2000 | Pope et al. |
| 6,124,083 | A | 9/2000 | Majumdar et al. |
| 6,197,486 | B1 | 3/2001 | Majumdar et al. |
| 6,207,361 | B1 | 3/2001 | Greener et al. |
| 6,291,396 | B1 | 9/2001 | Bodem et al. |
| 6,429,248 | B2 | 8/2002 | Schwark et al. |
| 6,566,033 | B1 | 5/2003 | Majumdar et al. |
| 6,838,165 | B2 | 1/2005 | Majumdar et al. |
| 6,872,501 | B2 | 3/2005 | Majumdar et al. |
| 6,881,704 | B2 | 4/2005 | Sakamoto et al. |
| 6,893,592 | B2 | 5/2005 | Arrington et al. |
| 6,897,183 | B2 | 5/2005 | Arrington et al. |

FOREIGN PATENT DOCUMENTS

| | | |
|---|---|---|
| EP | 0 540 991 | 5/1993 |
| EP | 1 403 701 | 3/2004 |

*Primary Examiner* — Bruce H Hess
(74) *Attorney, Agent, or Firm* — Lynne M. Blank; J. Lanny Tucker

(57) ABSTRACT

The present invention relates to an image recording element comprising a support having thereon an aqueous subbing layer and an extruded dye receiving layer, wherein the image recording element is a thermal dye receiver. The present invention also relates to a method of making a thermal dye receiving element comprising providing a support for an imaging element; applying an aqueous subbing layer to the support; and extruding thereon at least one thermal dye receiving layer.

22 Claims, No Drawings

AQUEOUS SUBBING FOR EXTRUDED THERMAL DYE RECEIVER

FIELD OF THE INVENTION

The present invention relates to aqueous subbing layers for extruded dye receiving elements.

BACKGROUND OF THE INVENTION

Thermal transfer systems have been developed to obtain prints from pictures, which have been generated from a camera or scanning device. According to one way of obtaining such prints, an electronic picture is first subjected to color separation by color filters. The respective color-separated images are converted into electrical signals. These signals are operated on to produce cyan, magenta and yellow electrical signals. The signals are transmitted to a thermal printer. To obtain the print, a cyan, magenta or yellow dye-donor element is placed face-to-face with a dye-receiving element. The two are inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other two colors. A color hard copy is thus obtained which corresponds to the original picture viewed on a screen.

Dye receiving elements used in thermal dye transfer generally include a support (transparent or reflective) bearing on one side thereof a dye image-receiving layer, and, optionally, additional layers. The dye image-receiving layer conventionally comprises a polymeric material chosen from a wide assortment of compositions for its compatibility and receptivity for the dyes to be transferred from the dye donor element. Dye must migrate rapidly in the layer during the dye transfer step and become immobile and stable in the viewing environment. Care must be taken to provide a receiving layer which does not stick to the hot donor as the dye moves from the surface of the receiving layer and into the bulk of the receiver. An overcoat layer can be used to improve the performance of the receiver by specifically addressing these latter problems. An additional step, referred to as fusing, may be used to drive the dye deeper into the receiver.

The receiving layer must act as a medium for dye diffusion at elevated temperatures, yet the transferred image dye must not be allowed to migrate from the final print. Retransfer is potentially observed when another surface comes into contact with a final print. Such surfaces may include paper, plastics, binders, backside of (stacked) prints, and some album materials. Polycarbonates and polyesters have both been used in image-receiving layers. The term "polycarbonate" as used herein means a polyester of carbonic acid and a diol or diphenol. For example, polycarbonates have been found to be desirable image-receiving layer polymers because of their effective dye compatibility and receptivity. As set forth in U.S. Pat. No. 4,695,286, incorporated herein by reference, bisphenol-A polycarbonates of number average molecular weights of at least about 25,000 have been found to be especially desirable in that they also minimize surface deformation which may occur during thermal printing. These polycarbonates, however, do not always achieve dye transfer densities as high as may be desired, and their stability to light fading may be inadequate. U.S. Pat. No. 4,927,803, incorporated herein by reference, discloses that modified bisphenol-A polycarbonates obtained by co-polymerizing bisphenol-A units with linear aliphatic diols may provide increased stability to light fading compared to unmodified polycarbonates. Such modified polycarbonates, however, are relatively expensive to manufacture compared to the readily available bisphenol-A polycarbonates, and they are generally made in solution from hazardous materials (e.g. phosgene and chloroformates) and isolated by precipitation into another solvent. The recovery and disposal of solvents coupled with the dangers of handling phosgene make the preparation of specialty polycarbonates a high cost operation.

Polyesters, on the other hand, can be readily synthesized and processed by melt condensation using no solvents and relatively innocuous chemical starting materials. Polyesters formed from aromatic diesters (such as disclosed in U.S. Pat. No. 4,897,377, incorporated herein by reference,) generally have good dye up-take properties when used for thermal dye transfer; however, they exhibit severe fade when the dye images are subjected to high intensity daylight illumination. Polyesters formed from alicyclic diesters are disclosed in U.S. Pat. No. 5,387,571 of Daly, incorporated herein by reference, the disclosure of which is incorporated by reference. These alicyclic polyesters also generally have good dye up-take properties, but their manufacture requires the use of specialty monomers which add to the cost of the receiver element. Polyesters formed from aliphatic diesters generally have relatively low glass transition temperatures, which frequently results in receiver-to-donor sticking at temperatures commonly used for thermal dye transfer. When the donor and receiver are pulled apart after imaging, one or the other fails and tears and the resulting images are unacceptable.

U.S. Pat. No. 5,302,574 to Lawrence, incorporated herein by reference, et al. discloses a dye-receiving element for thermal dye transfer comprising a support having on one side thereof a dye image-receiving layer, wherein the dye image-receiving layer comprises a miscible blend of an unmodified bisphenol-A polycarbonate having a number molecular weight of at least about 25,000 and a polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 30 mole % of the diol derived units containing an aromatic ring not immediately adjacent to each hydroxyl group of the corresponding diol or an alicyclic ring. The alicyclic polyesters were found to be compatible with high molecular weight polycarbonates.

U.S. Pat. No. 4,908,345 to Egashira et al., incorporated herein by reference, discloses a dye receiving layer comprising a phenyl group (e.g. bisphenol A) modified polyester resin synthesized by the use of a polyol having a phenyl group as the polyol compound. U.S. Pat. No. 5,112,799, also to Egashira et al., incorporated herein by reference, discloses a dye-receiving layer formed primarily of a polyester resin having a branched structure.

Polymers may be blended for use in the dye-receiving layer in order to obtain the advantages of the individual polymers and optimize the combined effects. For example, relatively inexpensive unmodified bisphenol-A polycarbonates of the type described in U.S. Pat. No. 4,695,286 may be blended with the modified polycarbonates of the type described in U.S. Pat. No. 4,927,803 in order to obtain a receiving layer of intermediate cost having both improved resistance to surface deformation which may occur during thermal printing and to light fading which may occur after printing.

It is always desirable to improve image recording elements with an image-receiving layer in terms of providing excellent image properties and economic manufacture. It would be especially desirable to provide a receiver element for thermal dye transfer processes with an image receiving layer having excellent dye uptake and image dye stability, retransfer resistance, and which can be effectively printed in a thermal printer.

A vast majority of dye receiver layers (DRL) are coated from solvent based compositions, for example, U.S. Pat. Nos. 5,411,931; 6,096,685; 6,291,396; and references therein, all incorporated herein by reference. In order to improve adhesion of the dye receiving layer to the support of the imaging element, U.S. Pat. Nos. 4,774,224; 4,814,321 and 4,748,150, all incorporated herein by reference, disclose dye-receiving elements for thermal dye transfer comprising polyethylene coated supports having thereon a subbing layer of a vinylidene chloride copolymer coated out of a solvent and a polymeric dye image-receiving layer, also coated out of a solvent. While the use of such vinylidene chloride copolymer subbing layers improves the adhesion of the dye image-receiving layer to polyethylene coated supports, it has been found, as stated in U.S. Pat. No. 4,965,238 that adhesion to other polyolefins such as polypropylene is not as good. Even in the case of polyethylene, in some instances where the use of vinylidene chloride copolymers gives apparently acceptable initial adhesion, adhesion after thermal transfer of a dye image is poor.

U.S. Pat. Nos. 4,965,238 and 4,965,239, both incorporated herein by reference, disclose use of subbing layers which are solvent coated and the polymer used for the subbing layer has an inorganic backbone of an oxide of zirconium or titanium. An alcohol based subbing layer has been disclosed in U.S. Pat. No. 5,384,304, incorporated herein by reference, wherein a mixture of an aminofunctional organo-oxysilane and a hydrophobic organo-oxysilane is coated over the support, and further overcoated with a dye receiving layer from a solvent based composition. U.S. Pat. No. 5,858,916, incorporated herein by reference, discloses a similar subbing layer comprising a mixture of an aminofunctional organo-oxysilane and a hydrophobic organo-oxysilane, but further comprising a salt for ionic conductivity, for reducing charge generation during transport through a thermal printer. U.S. Pat. No. 6,881,704, incorporated herein by reference, disclosed solvent based intermediate layers comprising a resin and acicular inorganic particles, overcoated with solvent based DRL, for alleged improvement in cracking.

Thermally extruded dye receiver layers (DRL) have recently been introduced for thermal receiver media, as disclosed in U.S. Pat. Nos. 6,893,592 and 6,897,183, incorporated herein by reference. These patents teach a polyester-based dye receiving layer extruded onto a support that typically comprises a paper core laminated with a microvoided polyolefin sheet, usually biaxially oriented polypropylene (BOPP), on the face side and a non-microvoided polyolefin sheet, also preferably a biaxially oriented polypropylene, on the backside. As compared to a solvent coated dye receiving layer, the extruded dye receiving layer has significantly less adhesion to the support. The polyester based dye receiving layer alone, in which the polypropylene which is amorphous, has very little adhesion to the substrate which is typically semi-crystalline and requires an adhesion promoting tie-layer, as described in U.S. Pat. Nos. 6,893,592, co1.7, lines 56-60, incorporated herein by reference.

U.S. Pat. Nos. 6,893,592 and 6,897,183, incorporated herein by reference, disclose polyolefin based tie-layers that are co-extruded with the dye receiving layer onto the substrate. Although adhesion is adequate for kiosk printers, it has recently been observed that there is scope for improvement in the adhesion of the dye receiving layer with such co-extruded tie-layers for printing in new generation of thermal home printers that utilize borderless (full bleed) printing, providing edge-to-edge image coverage. In case of inadequate adhesion, printing in these printers can run the risk of print delamination, resulting in unsatisfactory prints.

The polyolefin based tie-layers described in the aforementioned two patents also serve to provide antistatic characteristics. The preferred antistatic materials comprise polyether based polymers. These polymers typically provide humidity sensitive ionic conductivity. Numerous such polymers are disclosed in U.S. Pat. Nos. 6,197,486; 6,207,361; 6,838,165; 6,872,501 and references therein, all incorporated herein by reference.

Antistatic materials for imaging elements that comprise humidity-independent electronic conductors are also well known in the art. These electronic conductors can be metal-containing particles, conjugated polymers, various forms of carbon and the like. Application of such materials in imaging has been described in detail in the patent art; vide for example U.S. Pat. Nos. 5,368,995; 5,719,016; 6,124,083; 6,429,248; 6,566,033 and references therein, all incorporated herein by reference. Although some of these patents may suggest the use of these antistatic layers in imaging elements including thermal receivers, there is no description of any thermal media wherein a dye receiving layer is thermally extruded over such antistatic layers.

U.S. Pat. No. 5,719,016 teaches of an antistatic layer comprising acicular tin oxide dispersed in a binder incorporated in imaging elements. Although the imaging elements include thermal receivers, there is no description of any thermal media wherein a dye receiving layer is thermally extruded over the antistat layer. U.S. Pat. No. 5,719,016 does not disclose a binder with strong adhesion to biaxially oriented polypropylene and thermally extruded polyester. In fact, the binders used in Examples 3-5 (i.e., terpolymer of acrylonitrile, vinylidene chloride and acrylic acid and polyester ionomer) have little adhesion to biaxially oriented polypropylene and will not be useful in extruded thermal receiving elements.

U.S. Pat. No. 5,718,995 teaches of an antistatic layer comprising a conductive agent and polyurethane with an ultimate elongation to break of at least 350 percent, coated over energetically treated polyester surface. The aforesaid antistatic layer was further overcoated with a transparent magnetic layer, which is coated from a solvent, as per Research Disclosure, Item 34,390. U.S. Pat. No. 5,718,995, however, does not mention of any thermally processable layer extruded over the antistat layer.

U.S. Pat. No. 5,646,090 discloses thermal transfer image receiving sheet comprising a substrate, an intermediate layer containing polyurethane of Tg≧40° C., and a dye receiving layer. However, in this patent, the intermediate layer and the dye receiving layer are both coated out of solvent mixtures, and no teaching is made of any thermally extruded layer.

PROBLEM TO BE SOLVED

There remains a need for improved adhesion of extruded dye receiving layers to laminate supports. In addition, there remains a need for improved antistatic performance in extruded dye receiving elements.

There is a need for a superior adhesion-promoting layer, which provides excellent adhesion to the underlying hydrophobic substrate, typically biaxially oriented polypropylene surface, and to the overlying polyester based thermally extruded dye receiving layer, ensuring no delamination during borderless or edge-to-edge printing in the new printers.

SUMMARY OF THE INVENTION

The present invention relates to an image recording element comprising a support having thereon an aqueous subbing layer and an extruded dye receiving layer, wherein the image recording element is a thermal dye receiver. The present invention also relates to a method of making a thermal dye receiving element comprising providing a support for an imaging element; applying an aqueous subbing layer to the support; and extruding thereon at least one thermal dye receiving layer.

ADVANTAGEOUS EFFECT OF THE INVENTION

The present invention includes several advantages, not all of which are incorporated in a single embodiment. It is always desirable to improve image recording elements with an image-receiving layer in terms of providing excellent image properties and economic manufacture. It would be especially desirable to provide a receiver element for thermal dye transfer processes with an image receiving layer having excellent dye uptake and image dye stability, retransfer resistance, and which can be effectively printed in a thermal printer.

The present invention provides superior adhesion between an extruded dye receiving layer which is typically amorphous and a semi-crystalline support which has low surface energy. In addition to its superior adhesion, the aqueous subbing layer has the following advantages, especially with respect to a thermal receiving element having co-extruded tie-layers to promote adhesion between extruded dye receiving layer(s) and a support:

(1) Being aqueous, these coating formulations are environmentally attractive and can be coated utilizing a variety of equipment.

(2) The subbing layer can be thin (<1 micron) and therefore provides less separation between the dye receiving layer and the highly insulating and compliant microvoided layer, affording printing at a lower voltage.

(3) The aqueous subbing layer allows the incorporation of relative humidity (RH)-independent electronically conductive materials, which are typically difficult to process thermally, that is, for incorporation in a co-extruded tie layer.

(4) The aqueous subbing layer obviates the need for co-extrusion of dye receiving layer and adhesion promoting tie-layer.

DETAILED DESCRIPTION OF THE INVENTION

The present invention relates to a thermal dye receiver comprising a support having thereon an aqueous subbing layer and an extruded dye receiving layer and a method for making the same. By "aqueous" it is meant that the subbing layer is coated from a coating composition wherein the coating medium is substantially water. In case any organic solvent is added to the coating medium, its amount is not to exceed 15% by weight, preferably 10% by weight more preferably 5% by weight and most preferably 1% by weight of the coating composition.

The invention provides an aqueous coated subbing layer with improved adhesion, obviating the need for a co-extruded tie layer. The aqueous subbing layers of the invention provide excellent adhesion to the support surface, as well as excellent adhesion to the thermally extruded dye receiving layer. When printed without borders, that is, the image is printed from media edge to media edge, in the new home printers, these aqueous subbing layers cause no delamination. Borderless printing eliminates the need to provide a removeable portion of the media to produce an image covering the entire surface area of the print. Additionally, these subbing layers can be made antistatic through the incorporation of a suitable conductive agent.

The provision of superior adhesion in an adhesion-promoting layer, which provides excellent adhesion to the underlying hydrophobic substrate, typically biaxially oriented polypropylene surface, and to the overlying polyester based thermally extruded dye receiving layer, ensuring no delamination during borderless printing in the new printers is a challenging proposition since adhesion to biaxially oriented polypropylene is difficult to begin with, because of its very low surface energy. Moreover, adhesion of a thermally extruded thin polyester layer, for example, of 2-4 microns in thickness, to any surface at high speed coating, for example, 100-300 meter/min, is also difficult because of the low residence time before the melt is rapidly quenched by chilled nip rollers.

The terms as used herein, "top", "upper", "emulsion side", and "face" mean the side or toward the side of the photographic imaging layers or developed image. The terms "face stock", "support" and "substrate" mean the material bearing the imaging layers. The terms "bottom", "lower side", "liner" and "back" mean the side or toward the side of the imaging layers or developed image.

The aqueous subbing layer primarily comprises an adhesion promoting layer that has excellent adhesion to the substrate as well as the thermally extruded dye receiving layer (DRL). Typically, the adhesion promoting layer comprises a film-forming polymer which can be one or more of a water soluble polymer, a hydrophilic colloid or a water insoluble polymer latex or dispersion. However, it is preferred that the subbing layer is an adhesion promoting layer that is humidity insensitive, in order to ensure invariant performance under a wide range of humidity conditions at users end. In this regard, it is preferred that the film-forming polymer, upon drying, absorbs less than 10%, preferably less than 5% and more preferably less than 2% and most preferably less than 1% of its weight of moisture under 80% RH at 23° C.

Particular preference is given to polymers selected from the group of polymers and interpolymers prepared from ethylenically unsaturated monomers such as styrene, styrene derivatives, acrylic acid or methacrylic acid and their derivatives, olefins, chlorinated olefins, (meth)acrylonitriles, itaconic acid and its derivatives, maleic acid and its derivatives, vinyl halides, vinylidene halides, vinyl monomer having a primary amine addition salt, vinyl monomer containing an aminostyrene addition salt and others. Also included are polymers such as polyurethanes and polyesters. It is preferred that the Tg of the binder polymer is below 45° C., more preferred to be below 40° C., and most preferred to be below 25° C. and ideally at or below 15° C., in order to ensure sufficient flow during thermal extrusion of the dye receiving layer over the subbing layer, and thus afford adhesion. The binder polymer can be semi-crystalline or amorphous, the latter being preferable. Particularly preferred binder polymers are those disclosed in U.S. Pat. Nos. 6,171,769; 6,120,979; and 6,077,656; 6,811,724; and 6,835,516, incorporated herein by reference, because of their excellent adhesion characteristics.

In order to provide appropriate static protection to the imaging element of the invention during its manufacturing, finishing and end use, it is desirable that the aqueous subbing layer comprises an electrically conductive material. Any electrically conductive material can be used for this purpose.

Electrically conductive materials can be divided into two broad groups: (i) ionic conductors and (ii) electronic conductors. In ionic conductors charge is transferred by the bulk diffusion of charged species through an electrolyte. Although relatively inexpensive, the resistivity is dependent on temperature and humidity. The conductivity of an electronic conductor depends on electronic mobility rather than ionic mobility and is independent of humidity. Electronically conducting materials can be expensive and may impart unfavorable physical characteristics, such as color, increased brittleness and poor adhesion.

Electronic conductors such as conjugated conducting polymers, conducting carbon particles including single- or multi-walled carbon nanotubes, crystalline semiconductor particles, amorphous semiconductive fibrils, and continuous conductive metal or semiconducting thin films can be used in this invention to afford humidity independent, process-surviving antistatic protection. Of the various types of electronic conductors, electronically conductive metal-containing particles, such as semiconducting metal oxides, and electronically conductive polymers, such as, substituted or unsubstituted polythiophenes, substituted or unsubstituted polypyrroles, and substituted or unsubstituted polyanilines are particularly effective for the present invention.

Conductive metal-containing particles, which may be used in the present invention, include conductive metal particles, inorganic oxides, metal antimonates, and inorganic non-oxides. Particularly suitable inorganic oxides include crystalline inorganic oxides such as zinc oxide, titania, tin oxide, alumina, indium oxide, silica, magnesia, barium oxide, molybdenum oxide, tungsten oxide, and vanadium oxide or composite oxides thereof, as described in, e.g., U.S. Pat. Nos. 4,275,103, 4,394,441, 4,416,963, 4,418,141, 4,431,764, 4,495,276, 4,571,361, 4,999,276 and 5,122,445, all incorporated herein by reference. The conductive crystalline inorganic oxides may contain a "dopant" in the range from 0.01 to 30 mole percent, preferred dopants being aluminum or indium for zinc oxide, niobium or tantalum for titania, and antimony, niobium or halogens for tin oxide. Alternatively, the conductivity can be enhanced by formation of oxygen defects by methods well known in the art. The use of antimony-doped tin oxide at an antimony doping level of at least 8 atom percent and having an X-ray crystallite size less than 100 Å and an average equivalent spherical diameter less than 15 nm but no less than the X-ray crystallite size as taught in U.S. Pat. No. 5,484,694, incorporated herein by reference, is specifically contemplated.

Another useful category of electronically conductive metal-containing particles, which may be used in the layer of the invention, includes acicular doped metal oxides, acicular metal oxide particles, and acicular metal oxides containing oxygen deficiencies. In this category, acicular doped tin oxide particles, particularly acicular antimony-doped tin oxide particles, acicular niobium-doped titanium dioxide particles, and the like are preferred because of their availability. The aforesaid acicular conductive particles preferably have a cross-sectional diameter less than or equal to 0.02 μm and an aspect ratio greater than or equal to 5:1. Some of these acicular conductive particles, useful for the present invention, are described in U.S. Pat. Nos. 5,719,016, 5,731,119, 5,939,243 and references therein, incorporated herein by reference.

If used, the volume fraction of the acicular electronically conductive metal oxide particles in the dried antistatic layer of the invention can vary from 1 to 70% and preferably from 2 to 50% for optimum physical properties. For non-acicular electronically conductive metal oxide particles, the volume fraction can vary from 1 to 90%, and preferably from 5 to 80% for optimum properties.

The invention is also applicable where the conductive agent comprises a conductive "amorphous" gel such as vanadium oxide gel comprised of vanadium oxide ribbons or fibers. Such vanadium oxide gels may be prepared by any variety of methods, including but not specifically limited to melt quenching as described in U.S. Pat. No. 4,203,769, incorporated herein by reference, ion exchange as described in DE 4,125,758, incorporated herein by reference, or hydrolysis of a vanadium oxoalkoxide as claimed in WO 93/24584, incorporated herein by reference. The vanadium oxide gel is preferably doped with silver to enhance conductivity. Other methods of preparing vanadium oxide gels, which are well known in the literature, include reaction of vanadium or vanadium pentoxide with hydrogen peroxide and hydrolysis of $VO_2OAc$ or vanadium oxychloride.

Conductive metal antimonates suitable for use in accordance with the invention include those as disclosed in, U.S. Pat. Nos. 5,368,995 and 5,457,013, for example, both incorporated herein by reference. Preferred conductive metal antimonates have a rutile or rutile-related crystallographic structures and may be represented as M+2 Sb+5 2 O 6 (where M+2=Zn+2, Ni+2, Mg+2, Fe+2, Cu+2, Mn+2, Co+2) or M+3 Sb+5 O 4 (where M+3=In+3, Al+3, Sc+3, Cr+3, Fe+3). Several colloidal conductive metal antimonate dispersions are commercially available from Nissan Chemical Company in the form of aqueous or organic dispersions. Alternatively, U.S. Pat. Nos. 4,169,104 and 4,110,247, both incorporated herein by reference, teach a method for preparing M+2 Sb+5 2 O 6 by treating an aqueous solution of potassium antimonate with an aqueous solution of an appropriate metal salt (e.g., chloride, nitrate, sulfate) to form a gelatinous precipitate of the corresponding insoluble hydrate which may be converted to a conductive metal antimonate by suitable treatment. If used, the volume fraction of the conductive metal antimonates in the dried antistatic layer can vary from 15 to 90%. But it is preferred to be between 20 to 80% for optimum physical properties.

Conductive inorganic non-oxides suitable for use as conductive particles in the present invention include metal nitrides, metal borides and metal silicides, which may be acicular or non-acicular in shape. Examples of these inorganic non-oxides include titanium nitride, titanium boride, titanium carbide, niobium boride, tungsten carbide, lanthanum boride, zirconium boride, molybdenum boride and the like. Examples of conductive carbon particles, suitable for incorporation in the layer of the invention as conductive agent, include carbon black and carbon fibrils or nanotubes with single walled or multi-walled morphology. Example of such suitable conductive carbon particles can be found in U.S. Pat. No. 5,576,162 and references therein, incorporated herein by reference.

Suitable electrically conductive polymers that are preferred for incorporation in layer of the invention are specifically electronically conducting polymers, such as those illustrated in U.S. Pat. Nos. 6,025,119, 6,060,229, 6,077,655, 6,096,491, 6,124,083, 6,162,596, 6,187,522, and 6,190,846, all incorporated herein by reference. These electronically conductive polymers include conjugated polymers such as substituted or unsubstituted aniline-containing polymers (as disclosed in U.S. Pat. Nos. 5,716,550, 5,093,439 and 4,070,189, both incorporated herein by reference), substituted or unsubstituted thiophene-containing polymers (as disclosed in U.S. Pat. Nos. 5,300,575, 5,312,681, 5,354,613, 5,370,981, 5,372,924, 5,391,472, 5,403,467, 5,443,944, 5,575,898, 4,987,042 and 4,731,408, all incorporated herein by reference), substituted or unsubstituted pyrrole-containing polymers (as disclosed in U.S. Pat. Nos. 5,665,498 and 5,674,654, both incorporated herein by reference), and poly (isothianaphthene) or derivatives thereof. These conducting polymers may be soluble or dispersible in organic solvents or water or mixtures thereof. Preferred conducting polymers for the present invention include polypyrrole styrene sulfonate (referred to as polypyrrole/poly(styrene sulfonic acid) in U.S. Pat. No. 5,674,654, incorporated herein by reference), 3,4-dialkoxy substituted polypyrrole styrene sulfonate, and 3,4-dialkoxy substituted polythiophene styrene sulfonate because of their color. The most preferred substituted electronically conductive polymers include poly(3,4-ethylene dioxythiophene styrene sulfonate), such as Baytron® P, P HC, P AG supplied by Bayer Corporation, for its apparent availability in relatively large quantity. The weight % of the conductive polymer in the dried subbing layer of the invention can vary from 1 to 99% but preferably varies from 2 to 30% for optimum physical properties.

Humidity dependent, ionic conductors are traditionally more cost-effective than electronic conductors and find widespread use in reflective imaging media such as paper. Any such ionic conductor can be incorporated in the antistatic layer of the invention. The ionic conductors can comprise inorganic and/or organic salt. Alkali metal salts particularly those of polyacids are effective. The alkali metal can comprise lithium, sodium or potassium and the polyacid can comprise polyacrylic or polymethacrylic acid, maleic acid, itaconic acid, crotonic acid, polysulfonic acid or mixed polymers of these compounds, as well as cellulose derivatives. The alkali salts of polystyrene sulfonic acid, napthalene sulfonic acid or an alkali cellulose sulfate are preferred for their performance.

Polymerized alkylene oxides, particularly combinations of polymerized alkylene oxides and alkali metal salts, described in U.S. Pat. Nos. 4,542,095 and 5,683,862 incorporated herein by reference, are also preferred. Specifically, a combination of a polyethylene ether glycol and lithium nitrate is a desirable choice because of its performance and cost. In such a combination, the combined weight % of the polyethylene ether glycol and lithium nitrate in the dry subbing layer can vary preferably between 1-50%, more preferably between 1-30%, and most preferably between 5-10%. Furthermore, in such a combination, the weight ratio of polyethylene ether glycol to lithium nitrate in the dry subbing layer can vary preferably between 1/99 to 99/1, more preferably between 10/90 and 90/10 and most preferably between 20/80 and 80/20.

Also, preferred are inorganic particles such as electrically conductive synthetic or natural smectite clay as conductive agents in the subbing layer of the invention.

Of particular preference for application in the present invention are those ionic conductors, which are disclosed in U.S. Pat. Nos. 5,683,862, 5,869,227, 5,891,611, 5,981,126, 6,077,656, 6,120,979, 6,171,769, and references therein, all incorporated herein by reference.

The conductive particles that can be incorporated in the aqueous subbing layer are not specifically limited in particle size or shape. The particle shape may range from roughly spherical or equiaxed particles to high aspect ratio particles such as fibers, whiskers, tubes, platelets or ribbons. Additionally, the conductive materials described above may be coated on a variety of other particles, also not particularly limited in shape or composition. For example the conductive inorganic material may be coated on non-conductive silica, alumina, titania and mica particles, whiskers or fibers.

The aqueous subbing layer of the invention may comprise a colloidal sol, which may or may not be electrically conductive, to improve physical properties such as durability, roughness, coefficient of friction, as well as to reduce cost. Preferred colloidal sols include finely divided inorganic particles in a liquid medium, preferably water. Most preferably the inorganic particles are metal oxide based. Such metal oxides include tin oxide, titania, antimony oxide, zirconia, ceria, yttria, zirconium silicate, silica, alumina, such as boehmite, aluminum modified silica, as well as other inorganic metal oxides of Group III and IV of the Periodic Table and mixtures thereof. The selection of the inorganic metal oxide sol is dependent on the ultimate balance of properties desired as well as cost. Inorganic particles such as silicon carbide, silicon nitride and magnesium fluoride when in sol form are also useful for the present invention. The inorganic particles of the sol have an average particle size less than 100 nm, preferably less than 70 nm and most preferably less than 40 nm. A variety of colloidal sols useful in the present invention are commercially available from DuPont, Nalco Chemical Co., and Nyacol Products Inc.

The weight % of the inorganic particles of the aforesaid sol are preferred to be at least 5% and more preferred to be at least 10% of the dried layer of the invention to achieve the desired physical properties.

The aqueous subbing layer of the invention can comprise any number of addenda for any specific reason. These addenda can include tooth-providing ingredients (vide U.S. Pat. No. 5,405,907, for example, incorporated herein by reference), surfactants, defoamers or coating aids, charge control agents, thickeners or viscosity modifiers, coalescing aids, crosslinking agents or hardeners, soluble and/or solid particle dyes, antifoggants, fillers, matte beads, inorganic or polymeric particles, adhesion promoting agents, bite solvents or chemical etchants, lubricants, plasticizers, antioxidants, voiding agents, colorants or tints, roughening agents, slip agent, UV absorbers, and others well-known in the art.

The aqueous subbing layer of the invention can be placed anywhere in the imaging element to fulfill any specific purpose. However it is preferably placed between the substrate and the extruded dye receiving layer.

For desirable static protection, the antistatic subbing layer of the invention may have a surface electrical resistivity or internal electrical resistivity of less than 13 log ohms/square, preferably less than 12 log ohms/square, more preferably less than 11 log ohms/square, and most preferably less than 10 log ohms/square. It is to be understood that conductive agents and/or static dissipative agents can be incorporated anywhere within the receiver besides the subbing layer. In order to obtain optimum static protection, it is preferred that the surface electrical resistivity or internal electrical resistivity of the receiver is less than 13 log ohms/square, preferably less than 12 log ohms/square, more preferably less than 11 log ohms/square, and most preferably less than 10 log ohms/square.

The aqueous subbing layer can be of any coverage (thickness). However, if the dry coverage of the subbing layer is too low, the adhesion may not be adequate; on the other hand, if the dry coverage is too high it may reduce dye-transfer efficiency during printing, as well as incur high cost unnecessarily. The dry coverage of the subbing layer is preferably between 100 $mg/m^2$ and 2000 $mg/m^2$, and preferably between 300 $mg/m^2$, and 600 $mg/m^2$.

The support for the image receiving layer of the invention may be transparent or reflective. Typical imaging supports may comprise cellulose nitrate, cellulose acetate, poly(vinyl acetate), poly(vinyl alcohol), poly(ether sulfone), polystyrene, polyolefins including polyolefin ionomers, polyesters including polyester ionomers, polycarbonate, polyamide, polyimide, glass, ceramic, metal, natural and synthetic paper, resin-coated or laminated paper, voided polymers including polymeric foam, hollow beads and microballoons, microvoided polymers and microporous materials, or fabric, or any combinations thereof. Preferred supports are those comprising paper, synthetic paper, and polymers such as polyesters, polyolefins and polystyrenes, mainly chosen for their desirable physical properties and cost. The support may be employed at any desired thickness, usually from about 10 μm to 1000 μm. For reflective supports, use of white pigments such as titania, zinc oxide, calcium carbonate, colorants, optical brighteners, and any other addenda known in the art is also contemplated.

In a preferred embodiment, the support comprises a paper core, which is laminated on the image receiving side. The laminate on the image receiving side comprises a microvoided layer that provides a compliant and thermally insulating layer suitable for thermal dye transfer, and a skin layer. The skin layer may be voided or non-voided, and may contain inorganic particles. The side of the paper core opposite to the image receiving side can be laminated with a suitable plastic sheet or coated with a resin. The laminate typically comprises an oriented polymer, such as biaxially oriented polypropylene, polyester, and the like. The resin coating if used typically comprises polyolefins such as polyethylene and polypropylene. Such supports are well known in the art, for example, disclosed in commonly assigned U.S. Pat. No. 5,244,861, EP0671281, and U.S. Pat. No. 5,928,990, which are hereby incorporated by reference in their entirety.

In one embodiment, the aqueous layer is formed from a coating composition, on the support surface on the image receiving side by any of the well known coating methods. The coating methods may include but not limited to hopper coating, curtain coating, rod coating, gravure coating, roller coating, dip coating, spray coating, and the like. The surface on which the coating composition is deposited can comprise any material, but preferably polyolefins, such as polyethylene, polypropylene; polystyrene and polyester. The surface on which the coating composition is deposited can be treated for improved adhesion by any of the means known in the art, such as acid etching, flame treatment, corona discharge treatment, glow discharge treatment or can be coated with a suitable primer layer. However, corona discharge treatment is the preferred means for adhesion promotion.

The dye image-receiving layer (DRL) is formed on the aqueous subbing layer, preferably by thermal extrusion. The dye image-receiving layer can comprise a polymeric material chosen for its compatibility and receptivity for the dyes to be transferred from a dye-donor element. During printing, a dye can migrate rapidly from a dye-donor layer into the dye image-receiving layer during the dye transfer step. The dye image-receiving layer composition can immobilize the dye and stabilize the dye in an intended viewing environment.

The dye image-receiving layer can include a thermoplastic material, for example, a polyester, a polyolefin, a polycarbonate, a vinyl polymer, a polyurethane, a polyvinyl chloride, a poly(styrene-co-acrylonitrile), a poly(caprolactone), or combinations thereof, such as blends or copolymers.

Polyester-polycarbonate blends suitable for the dye image-receiving layer can include unmodified bisphenol-A polycarbonates having a number molecular weight of at least 25,000, such as those disclosed in U.S. Pat. No. 4,695,286, incorporated herein by reference. Specific examples include MAKROLON 5700 (Bayer AG) and LEXAN 151 (General Electric Co.) polycarbonates.

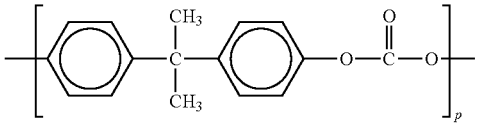

Lexan® 151: p ~ 120, Tg ~ 150° C.
Makrolon® 5700: p ~ 280, Tg ~ 157° C.

For polyester-polycarbonate blends, the polycarbonate can have a Tg of from 100° C. to 250° C., and the polyester can have a lower Tg than the polycarbonate. The Tg of the final polyester-polycarbonate blend can be between 40° C. and 100° C. Higher Tg polyester and polycarbonate polymers also can be useful.

According to various embodiments, the dye image-receiving layer can include a polyester having recurring dibasic acid derived units and diol derived units. A portion of the dibasic acid derived units, for example, at least 50 mole %, can include dicarboxylic acid derived units having an alicyclic ring within two carbon atoms of each carboxyl group of the corresponding dicarboxylic acid. A portion of the diol derived units, for example, at least 30 mole %, can have an aromatic ring not immediately adjacent to each hydroxyl group of the corresponding diol, or an alicyclic ring. Examples of such polyesters suitable for dye image-receiving layers include polyesters such as those found in U.S. Pat. No. 5,387,571, incorporated herein by reference.

In the case of an extrudable polyester, monomers (as a replacement for either a diacid and/or diol that has three or more functional groups, preferably one more multifunctional polyols or polyacids, and derivatives thereof) that can provide branching can be used, for example, multifunctional polyols, including but not limited to, glycerin, 1,1,1-trimethylolethane, 1,1,1-trimethylolpropane, and combinations thereof. Polyacids having more than two carboxylic acid groups (including esters or anhydrides derivatives thereof) include, for example, trimellitic acid, trimesic acid, 1,2,5-, 2,3,6- or 1,8,4-naphthalene tricarboxylic anhydride, 3,4,4'-diphenyltricarboxylic anhydride, 3,4,4'-diphenylmethanetricarboxylic anhydride, 3,4,4'-diphenylethertricarboxylic anhydride, 3,4,4'-benzophenonetricarboxylic anhydride acid, and derivatives thereof. Multifunctional polyols or anhydrides, for example, include compounds represented by the following structures:

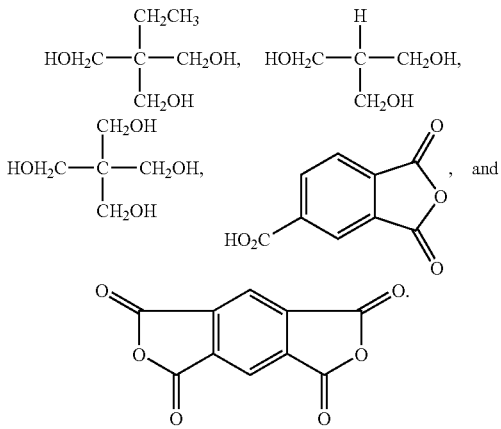

Examples of such extrudable branched polyesters include, for example, 1,4-cyclohexanedicarboxylic acid, 1,4-cyclohexanedimethanol, 4,4'-bis(2-hydroxyethyl)bisphenol-A, and 2-ethyl-2-(hydroxymethyl)-1,3-propanediol.

Various polymerization catalysts known to practitioners in the art can be used to make the polymers, for example, polyesters, for the dye-receiving layer. For example, a catalyst can be added in the amount of from 0.01% to 0.08% by weight solids to the polymer composition of the dye image-receiving layer to prevent or minimize trans esterification.

A plasticizer can be present in the dye image-receiving layer in any effective amount. For example, the plasticizer can be present in an amount of from 5% to 100%, or from 4% to 30%, based on the weight of the polymer in the dye-receiving layer. According to various embodiments, an aliphatic ester plasticizer can be used in the dye-receiving layer. Suitable aliphatic ester plasticizers can include both monomeric esters and polymeric esters. Examples of aliphatic monomeric esters include ditridecyl phthalate, dicyclohexyl phthalate, and dioctylsebacate. Examples of aliphatic polyesters include polycaprolactone, poly(butylene adipate) and poly(hexamethylene sebacate). Various aliphatic ester plasticizer, including polyesters or monomeric esters, are disclosed in U.S. Pat. No. 6,291,396, incorporated herein by reference. Phthalate ester plasticizers are disclosed in U.S. Pat. No. 4,871,715, incorporated herein by reference.

When the dye image-receiving layer is made by high temperature melt extrusion, a phosphorous-containing stabilizer can be added to the dye image-receiving layer to prevent degradation of the polyester polymer blend during extrusion. The phosphorous-containing stabilizer can be a phosphorous acid, an organic diphosphite such as bis(2-ethylhexyl)phosphite, a phosphate, an alkyl phosphate, an aryl phosphate, an inorganic phosphate, a phosphoric acid ester, or a phosphorous acid. The phosphorous stabilizer can be combined with a plasticizer such as dioctyl sebacate or the like. To improve compatibility, the plasticizer can be combined with the stabilizer prior to combining both with other components of the dye image-receiving layer.

The dye-receiving layer can include a release agent such as a modified polydimethylsiloxane. Suitable release agents are known in the art, and can include, for example, those described in U.S. patent application Ser. No. 10/729,567 to Kung et al., incorporated herein by reference, of the formula:

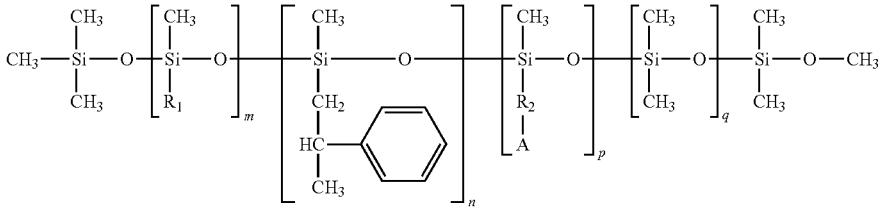

wherein $R_1$ is an alkyl chain of $C_9H_{19}$ or greater; $R_2$ is an alkyl chain of $C_3H_6$ or greater; A is NH—$R_3$, $NHNH_2$, NHCO—$R_3$, NH—$R_4$—$NH_2$, or NHCO—$R_4$—$NH_2$; $R_3$ is an alkyl chain of $C_2H_5$ or greater; $R_4$ is an alkyl chain of $C_2H_4$ or greater; m is from 0 to 95 weight percent; n is from 0 to 70 weight percent; p is from 0 to 40 weight percent; and q is from 0 to 95 weight percent, with the proviso that when m is 0, then n is 0, otherwise when m is greater than 0, n is from 0.1 to 70 weight percent, based on the total weight of the release agent. According to various embodiments, m can be from 20 to 80 weight percent, n can be from 1 to 80 weight percent, more preferably from 20 to 80 weight percent, and p can be from 20 to 40 weight percent when n and m are both 0, or any combination thereof. $R_1$, $R_2$, $R_3$ and $R_4$ can each independently be selected from straight or branched alkyl chains, except that when m and n are both 0, $R_3$ is an alkyl chain of $C_8H_{17}$ or greater. Suitable release agents can include, for example, GP-7101, GP-7105, GP-70-S, GP-74, and GP-154, all available from Genesee Polymers, Flint, Mich. Other suitable release agents can include, for example, those disclosed in U.S. Pat. Nos. 4,820,687 and 4,695,286, incorporated herein by reference, Silwet L-7230 and Silwet L-7001 from Crompton Corporation of Long Reach, W. Va., USA, and solid polydimethylsiloxanes such as but not limited to MB50-315 silicone, a 50:50 blend of bisphenol-A polycarbonate and ultrahigh MW polydimethyl siloxane, from Dow Corning of Midland, Mich., USA.

If present, the release agent can be present in the dye-receiving layer in an amount of greater than or equal to $5.5\times10^{-4}$ g/m$^2$. For example, the release agent can be present in an amount of greater than or equal to 0.001 g/m$^2$, from $5.5\times10^{-4}$ g/m$^2$ to 0.045 g/m$^2$, from $5.5\times10^{-4}$ g/m$^2$ to 0.02 g/m$^2$, or from 0.001 g/m$^2$ to 0.01 g/m$^2$.

The release agent can be present in one or more layers of the receiver element. For example, the release agent can be present in the dye image-receiving layer, a support, an adhesive layer, a tie-layer, an antistatic layer, or any other layer of the receiver element. When the support is a composite or laminate structure, the release agent can be in one or more layers of the support, for example, a base layer, a tie-layer, an adhesive layer, or a backing layer. According to various embodiments, the release agent can be in a layer between the base layer of the support and the dye image-receiving layer.

The dye-receiving layer can include alpha-tocopherol or a derivative thereof. An example of alpha-tocopherol is Vitamin E, available as Irganox® E201 from Ciba Specialty Chemicals, Inc., Tarrytown, N.Y. Alpha-tocopherol is known as 2,5,7,8,-tetramethyl-2-4(4',8',12'-trimethyltridecyl)-6-chromanol. Derivatives can include, for example, alpha-tocopherol acetates. Alpha-tocopherol can be present in an amount of at least 0.001 weight percent of the dye-receiving layer, for example, from 0.005 to 10 weight percent, from 0.01 to 2.0 weight percent, from 0.01 to 0.4 weight percent, or from 0.05 to 0.2 weight percent.

The release agent and alpha-tocopherol or a derivative thereof can be present in the dye-receiving layer in a ratio of from 100:1 to 1:1 by weight percent, for example, from 80:1 to 2:1, or from 16:1 to 4:1. The ratio will depend on the materials present in the dye-receiving layer. If the amount of alpha-tocopherol is too low, streaking and lines can occur on the dye-receiving layer. If the amount of alpha-tocopherol is too high, the Dmin of the receiver can become unacceptable for the desired application.

When used as a stabilizer and/or without the presence of a release agent, alpha-tocopherol or a derivative thereof can be present in the amounts indicated herein. Greater or lesser amounts can be used as needed, and can be determined by practitioners in the art.

The dye-receiving layer can be present in an amount, which is effective for its intended purpose. For example, the dye-receiving layer can have any coverage, preferably between 0.5 $g/m^2$ to 20 $g/m^2$, more preferably between 1.0 $g/m^2$ to 15 $g/m^2$, and most preferably between 3.0 $g/m^2$ to 10 $g/m^2$.

The dye-receiving layer can be present on one or both sides of the support. The dye-receiving layer can be single layered or multi-layered. Multi-layered elements can be formed simultaneously (by co-extrusion and/or curtain coating and/or any other method) or sequentially. In order to obtain good adhesion while maintaining desirable sensitometry, the thickness ratio of dye receiving layer to the aqueous subbing layer is preferably between 0.5:1 and 30:1, more preferably between 0.2:1 and 15:1 and most preferably between 2:1 and 10:1. The most preferred ratio is at least 3:1.

The dye receiving layer can be formed on a support over the aqueous subbing layer by any method known to practitioners in the art, including but not limited to printing, solution coating, dip coating, and extrusion coating, the latter being most preferred for the present invention. When the image-receiving layer is extruded, the process can include (a) forming a melt comprising the polymeric composition; (b) extruding or coextruding the melt as a single-layer film or a layer of a composite (multilayer or laminate) film; and (c) applying the extruded film to the support for the image-receiving element. In step (b), the melt can be extruded and cast as a film or laminate film at any desired thickness, for example, a thickness of at least 100 microns, for example, 100 to 800 microns, and then uniaxially or biaxially stretched to less than 10 microns, for example, 3-4 microns. The extruded uniaxially or biaxially stretched film can be applied to the support, for example, a moving web. Examples of suitable extruded dye—receiving layers include those disclosed in U.S. Pat. Nos. 5,387,571 and 5,302,574, both incorporated herein by reference. Receiver elements useful in this invention for image transfer can be used in thermal printing systems, electrostatic printing systems, and electrophotographic systems. Thermal printing systems can include thermal transfer of dye or colorant by sublimation, diffusion, or mass transfer processes.

It is critical that the receiver element prepared by the aforementioned method of coating the aqueous subbing layer of the invention on a suitable support and extruding the dye receiving layer over the subbing layer has adequate adhesion for its end use. This is ascertained by measuring peel force, through a preliminary tape test wherein a 1.27 cm wide adhesive tape such as 3M Scotch tape is adhered to the dye receiving layer over at least 35.6 cm of the dye receiving layer surface and rapidly pulled apart. The aqueous subbing layer provides enough adhesion so that it "passes" the tape test and no dye receiving layer is removed from the support. A more quantitative assessment of adhesion is accomplished by measuring the 1800 peel force for separation of the dye receiving layer from the support, which is described below.

Peel force for separation of the dye receiving layer of the receiver element from the support is determined using a Sintech measurement device (Alliance RT/30 supplied by MTS Systems Corporation). In this testing, a 1.27 cm wide Permacel P-252 tape is applied over the dye receiving layer of the receiver element edge-to-edge and pressed with a 5 lb (2.3 kg) roller over the sample. The tape is next peeled back from one of the edges of the receiver element at 180° with the dye receiving layer bonded to it over a gauge length of 4 inch (10.2 cm), at 1.65 cm/sec (39 inch/min) using a 2.3 kg (5 pound) load cell in the Sintech measurement device. The peel force measured in g/inch is reported as the peel force for separation of the dye receiving layer from the support. The test is conducted in both machine direction (MD) and cross direction (CD) of the support of the receiver element. The average of the two peel forces is reported as the average peel force for separation of the dye receiving layer from the support.

The average peel force for separation of the dye receiving layer should be at least 100 g/in (39.4 g/cm), preferably at least 120 g/in (47.2 g/cm), more preferably at least 130 g/in (51.2 g/cm), and most preferably at least 140 g/in (55.1 g/cm).

It is also useful to monitor the interface where failure (separation) occurs during the peel test. Failure within the microvoided laminate and/or the paper core demonstrates strong adhesion between (i) the extruded dye receiving layer and the aqueous subbing layer as well as strong adhesion between (ii) the aqueous subbing layer and the support.

Any dye transferable by heat can be used in the dye-donor layer of the thermal resistive head dye-donor element. The dye can be selected by taking into consideration hue, light fastness, and solubility of the dye in the dye donor layer binder and the dye image receiving layer binder. Dyes suitable for use in thermal resistive head donor elements are chosen in combination with a binder in the dye-donor layer of the donor element and in combination with the polymeric composition of the image-receiving layer of the image-receiving element, such that the receiver/donor dye partition coefficient between the dye in the dye-donor layer of the donor element and the dye in the image-receiving layer of the image-receiving element is 2.0 or greater. Each dye-donor layer patch can range from 20 wt. % to 90 wt. % dye, relative to the total dry weight of all components in the layer. The dye percent is ideally chosen in view of the specific donor and receiver combination.

The dye-donor layer can be formed or coated on a support. The dye-donor layer can be formed on the support by a printing technique such as but not limited to a gravure process, spin-coating, solvent-coating, extrusion coating, or other methods known to practitioners in the art. The support can be formed of any material capable of withstanding the heat of thermal printing. According to various embodiments, the support can be dimensionally stable during printing. The support can have a thickness of from 1 μm to 30 μm, for example, from 3 μm to 7 μm.

The dye-donor element can be a sheet of one or more colored patches or laminate, or a continuous roll or ribbon. The continuous roll or ribbon can include one patch of a monochromatic color or laminate, or can have alternating areas of different patches, for example, one or more dye patches of cyan, magenta, yellow, or black, one or more laminate patches, or a combination thereof.

The thermal dye-donor element and image-receiving element described herein, when placed in superimposed relationship such that the dye-donor layer of the dye-donor element is adjacent the dye image-receiving layer of the image-receiving element, can form a print assembly. An image can be formed by passing the print assembly past a print head, wherein the print head is located on the side of the dye-donor element opposite the image-receiving element. The print head can apply heat image-wise to the dye-donor element, causing the dyes in the dye-donor layer to transfer to the dye image-receiving layer of the image-receiving element. Thermal print heads that can be used with the print assembly are available commercially and known to practitioners in the art. Exemplary thermal print heads can include, but are not limited to, a Fujitsu Thermal Head (FTP-040 MCSOO1), a TDK Thermal Head F415 HH7-1089, a Rohm Thermal Head KE 2008-F3, a Shinko head (TH300U162P-001), and Toshiba heads (TPH162R1 and TPH207R1A).

When multiple color images are to be obtained, the print assembly is formed as many times as there are colors to be printed during the time when heat is applied by the thermal print head. After the first dye is transferred from a first dye-donor element, the dye-donor element and image-receiving element can be peeled apart. A second dye-donor element (or another area of the dye-donor element with a different dye) can be brought into register with the image-receiving element and the process can be repeated until all colors are printed. A laminate patch can also be printed on the image in this manner to protect the image.

For thermal printing, a donor element for superposition with the image-receiving element is required. For laser thermal printing, the donor element can include dyes or pigments suitable for sublimation or mass transfer from the donor to the image-receiving element on image-wise heating of the donor element with a laser. For resistive head thermal printing, a donor element including a diffusible colorant, preferably a dye, is used.

The thermal resistive head dye-donor element suitable for use with the image-receiving element described herein can include a dye-donor layer having one or more colored areas (patches) containing dyes suitable for printing. As used herein, a "dye" can be one or more dye, pigment, colorant, or a combination thereof, and can optionally be in a binder or carrier as known to practitioners in the art. During thermal resistive head printing, at least a portion of one or more colored areas can be transferred to the image-receiving element, forming a colored image on the image-receiving element. The dye-donor layer can include a laminate area (patch) having no dye. The laminate area can follow one or more colored areas. During thermal printing, the entire laminate area can be transferred to the image-receiving element. The dye-donor layer can include one or more colored areas and one or more laminate areas. For example, the dye-donor layer can include three color patches, for example, yellow, magenta, and cyan, and a clear laminate patch, for forming a three color image with a protective laminate layer on an image-receiving element.

The following examples are provided to illustrate the invention.

Support

The imaging supports used in the following examples and comparative samples comprise a paper core laminated on both the image receiving side and the opposite side. The laminate on the image receiving side was a commercially available packaging film OPPalyte® 350 TW made by Exxon Mobil. OPPalyte® 350 TW is a composite film (38 μm thick) (specific gravity 0.62) consisting of a microvoided and oriented polypropylene core (approximately 73% of the total film thickness), with a titanium dioxide pigmented non-microvoided oriented polypropylene layer on each side; the void-initiating material is poly(butylene terephthalate). The laminate on the opposite side was a commercially available oriented polypropylene film Bicor 70 MLT made by Exxon Mobil. Bicor 70MLT (18 μm thick) (specific gravity 0.9) is a one side matte finish and one side treated polypropylene film comprising a non-microvoided polypropylene core. The subbing layers were coated on the laminate (OPPalyte® 350 TW) surface on the image receiving side after corona discharge treatment.

Coating Compositions for the Aqueous Subbing Layer:

The following ingredients were used in the aqueous subbing layer of the Examples of the invention:

Neorez R 600, 30% by weight aqueous dispersion of polyurethane latex (Tg=−32° C., supplied by DSM Neoresins.

Polymer A, 10% by weight aqueous dispersion of a butyl acrylate-co-2-amynoethyl methacrylate hydrochloride-co-2-hydroxyethyl methacrylate in 50/5/45 weight ratio (Tg=−16° C.), as disclosed in U.S. Pat. No. 6,077,656 (Ins. 28-31, col. 9).

FS 10D, 20% by weight aqueous dispersion of antimony-doped conductive tin oxide supplied by Ishihara Corporation.

Ludox AM, 30% by weight aqueous dispersion of alumina modified colloidal silica supplied by DuPont Corporation.

The following coating compositions were prepared for the aqueous subbing layer, for the Examples of the invention:

| Composition A | |
|---|---|
| Neorez R 600 | 1166.72 g |
| FS 10D | 750 g |
| Water | 8083.28 g |
| **Composition B** | |
| Neorez R 600 | 1000.04 g |
| Ludox AM | 166.68 |
| FS 10D | 750 g |
| Water | 8083.28 g |
| **Composition C** | |
| Polymer A | 5000 g |
| Water | 5000 g. |

Examples of the Invention

Receiver samples were prepared in the following manner:

The aqueous coating compositions were hopper coated over the corona discharge treated surface of the laminate on the image receiving side of the support (OPPalyte® 350 TW) described herein above at various coverages. The coatings were dried at 82° C. The surface electrical resistance (SER) of the dry subbing layer was measured with a Trek Surface Resistance meter Model 152P-CR using concentric ring electrodes, following ANSI/ESD STM 11.11 standard.

The dye receiving layer, without any co-extruded tie-layer was subsequently extruded over the subbing layers of the invention. Details of the dye receiving layer are provided in Example 2 of U.S. Pat. No. 7,091,157 and incorporated herein by reference. Details of the Examples of the invention are provided herein below in Table 1.

TABLE 1

| Sample (invention) | Coating composition | Subbing layer dry coverage, mg/m$^2$ | Extruded DRL |
|---|---|---|---|
| Example 1 | A | 600 | Example 2, U.S. Pat. No. 7,091,157 without tie-layer |
| Example 2 | A | 500 | Example 2, U.S. Pat. No. 7,091,157 without tie-layer |

TABLE 1-continued

| Sample (invention) | Coating composition | Subbing layer dry coverage, mg/m$^2$ | Extruded DRL |
|---|---|---|---|
| Example 3 | A | 300 | Example 2, U.S. Pat. No. 7,091,157 without tie-layer |
| Example 4 | B | 600 | Example 2, U.S. Pat. No. 7,091,157 without tie-layer |
| Example 5 | B | 1000 | Example 2, U.S. Pat. No. 7,091,157 without tie-layer |
| Example 6 | C | 1000 | Example 2, U.S. Pat. No. 7,091,157 without tie-layer |

The receiver samples thus prepared were subjected to tape test. The average peel force for separation of the dye receiving layer from the support was also evaluated for each sample. The data are listed in Table 2.

TABLE 2

| Sample (invention) | Tape test | Average peel force g/in (g/cm) | SER log ohms/square |
|---|---|---|---|
| Example 1 | Passed | 145 (57.1) | 9.6 |
| Example 2 | Passed | 124 (48.8) | 9.5 |
| Example 3 | Passed | 136 (53.5) | 9.9 |
| Example 4 | Passed | 140 (55.1) | 9.6 |
| Example 5 | Passed | 151 (59.4) | 9.1 |
| Example 6 | Passed | 159 (62.6) | |

It is clear from Table 2 that the inventive samples all passed the tape test. It is also clear that the average peel force for separation of the dye receiving layer from the support is high, indicating excellent adhesion. For all six samples of the invention (Examples 1-6), the location of failure after peeling was found to be within the microvoided laminate, which further demonstrates the strong bonding at the dye receiving layer/subbing layer interface and the subbing layer/support interface. Moreover, Examples 1-5 which were coated from coating compositions A and B comprising antimony-doped conductive tin oxide (FS 10D) provided desirably low SER (9.1-9.6 log ohms/square) demonstrating their excellent anti-static characteristics.

Comparative Samples

Comparative sample Comp. 1 was prepared as per Example 2 of U.S. Pat. No. 7,091,157 with the co-extruded tie-layer, over the surface of the laminate (OPPalyte® 350 TW) on the image receiving side of the support.

Comparative samples Comp. 2-4 were prepared at various coverages, by coating organic solvent based subbing layers, as per Example 5, Sample E-6 of U.S. Pat. No. 5,858,916 (co1.11, lines 40-60) over the corona discharge treated surface of the laminate (OPPalyte® 350 TW) on the image receiving side of the support.

The subbing layers comprised a mixture of an aminofunctional organo-oxysilane, namely 3-aminopropyl triethoxysilane, (Prosil 221®, supplied by PCR Inc.) and a hydrophobic organo-oxysilane, namely an epoxy-terminated organo-oxysilane, (Prosil 2210® supplied by PCR Inc.) in 1:1 weight ratio and LiCl, coated from a primarily alcohol based coating composition. The overall dry composition of the subbing layer comprised Prosil 221®, Prosil 2210® and LiCl in the weight ratio of 1/1/0.3. The dye receiving layer, without any co-extruded tie-layer was subsequently extruded over the subbing layers, as in Examples 1-6. Comparative sample Comp.5 was prepared by coating the same subbing layer as in Comp.3 over the corona discharge treated surface of the laminate (OPPalyte® 350 TW) on the image receiving side of the support. However, the dye receiving layer in this case was coated from an organic solvent over the subbing layer. The DRL comprised a plasticized, crosslinked layer to Control Receiver C-2, as described in U.S. Pat. No. 6,291,396 (col. 6, line 60-col. 7, line 15).

The receiver samples thus prepared were subjected to tape test. The average peel force for separation of the dye receiving layer from the support was also evaluated for each sample. The data are listed in Table 3.

TABLE 3

| Sample (comparative) | Subbing layer | DRL | Tape test | Average peel force g/in (g/cm) |
|---|---|---|---|---|
| Comp. 1 | none | Extruded DRL with co-extruded tie-layer; Example 2, U.S. Pat. No. 7,091,157 | Passed | 79 (31.1) |
| Comp. 2 | Solvent based 50 mg/m$^2$; | Extruded DRL; Example 2, U.S. Pat. No. 7,091,157 without tie-layer | Failed | 9 (3.5) |
| Comp. 3 | Solvent based 100 mg/m$^2$; | Extruded DRL; Example 2, U.S. Pat. No. 7,091,157 without tie-layer | Failed | 13 (5.1) |
| Comp. 4 | Solvent based 200 mg/m$^2$; | Extruded DRL; Example 2, U.S. Pat. No. 7,091,157 without tie-layer | Failed | 10 (3.9) |
| Comp. 5 | Solvent based 100 mg/m$^2$; | Solvent based DRL; C-2, U.S. Pat. No. 6,291,396 | Passed | 67 (26.4) |

It is clear from Table 3 that in the absence an aqueous subbing layer, the adhesion of the dye receiving layer to the support is not at par with the Examples of the invention. It is also clear that solvent based subbing layers known in the art do not provide adequate adhesion for an extruded dye receiving layer, since samples Comp.2-4 failed tape test and resulted in very low peel force. A solvent based subbing layer overcoated with a solvent based dye receiving layer (Comp.5) has improved adhesion (passed tape test), but has a peel force lower than those of Examples 1-6.

Examples 1 and 6 and comparative sample Comp. 1 were printed in a KODAK EASYSHARE Printer Dock G600, a thermal home printer with "full bleed" (i.e., borderless printing, providing a print with edge-to-edge image coverage) under identical conditions. All samples demonstrated equivalent sensitometry. However, Examples 1 and 6 were found to be superior in performance compared to Comp. 1, as Examples 1 and 6 printed flawlessly without any delamination, whereas Comp. 1 printed with occasional delamination, depending on the severity of the printing conditions. The test demonstrated the effectiveness of the aqueous subbing layer of the invention in providing excellent adhesion of the extruded dye receiving layer to the support under a wide range of printing conditions.

The invention has been described in detail with particular reference to certain preferred embodiments thereof, but it will be understood that variations and modifications can be effected within the spirit and scope of the invention.

The invention claimed is:

1. An image recording element comprising a support having thereon a subbing layer comprising a binder polymer that is a water-insoluble polymer latex or dispersion, and an extruded dye receiving layer, wherein said image recording element is a thermal dye receiver and the subbing layer is between the support and the extruded dye receiving layer, wherein the binder polymer is: (1) a polymer or interpolymer prepared from an acrylic acid or methacrylic acid, olefin, chlorinated olefin, (meth)acrylonitrile, itaconic acid or its derivatives, maleic acid or its derivative, vinyl halide, a vinyl monomer having a primary amine addition salt, or vinyl monomer containing an aminostyrene addition salt; (2) a polyurethane; or (3) a polyester.

2. The image recording element of claim 1 wherein said subbing layer comprises polyurethane.

3. The image recording element of claim 2 wherein said polyurethane subbing layer adhesively attaches said support to said extruded dye receiving layer.

4. The image recording element of claim 1 wherein said subbing layer comprises an antistatic material.

5. The image recording element of claim 4 wherein said antistatic material comprises semiconducting metal oxides or electronically conductive polymers.

6. The image recording element of claim 5 wherein said semiconducting metal oxides or electronically conductive polymers comprise tin oxide or substituted or unsubstituted polythiophenes.

7. The image recording element of claim 1 wherein said subbing layer has a dry coverage of at least 300 mg/m$^2$.

8. The image recording element of claim 1 wherein said subbing layer has a thickness of less than 1 micron.

9. The image recording element of claim 1 wherein said subbing layer is humidity insensitive.

10. The image recording element of claim 9 wherein said subbing layer absorbs less than 10% of its weight of moisture under 80% RH at 23° C.

11. The image recording element of claim 1 wherein said subbing layer comprises a polymer having a Tg at or below 15° C.

12. The image recording element of claim 1 wherein said extruded dye receiving layer comprises polyester, polycarbonate, or a combination thereof.

13. The image recording element of claim 1 wherein said extruded dye receiving layer is from 2-4 microns in thickness.

14. The image recording element of claim 1 wherein said extruded dye receiving layer has a dry coverage of form 0.5 g/m$^2$ to 20 g/m$^2$.

15. The image recording element of claim 1 wherein the thickness ratio of said extruded dye receiving layer to said subbing layer is at least 3:1.

16. The image recording element of claim 1 wherein the extruded dye receiving layer has an average peel force for separation of at least 100 g/in (39.4 g/cm).

17. The image recording element of claim 1 wherein said support is a voided polyolefin laminate support.

18. The image recording element of claim 17 wherein said voided polyolefin laminate support comprises polyester or polypropylene.

19. The image recording element of claim 1 wherein said support comprises a paper core.

20. The image recording element of claim 1 wherein the binder polymer has a glass transition temperature ($T_g$) below 45° C.

21. The image recording element of claim 1 wherein the binder polymer has a $T_g$ at or below 15° C.

22. A method of making a thermal dye receiving element comprising:

providing a support for an imaging element;

applying an aqueous subbing layer comprising a binder polymer that is a water-insoluble polymer latex or dispersion to said support; and extruding thereon at least one thermal dye receiving layer, wherein the binder polymer is: (1) a polymer or interpolymer prepared from an acrylic acid or methacrylic acid, olefin, chlorinated olefin, (meth)acrylonitrile, itaconic acid or its derivatives, maleic acid or its derivative, vinyl halide, a vinyl monomer having a primary amine addition salt, or vinyl monomer containing an aminostyrene addition salt; (2) a polyurethane; or (3) a polyester.

* * * * *